US005643030A

United States Patent [19]

Brown

[11] Patent Number: 5,643,030

[45] Date of Patent: Jul. 1, 1997

[54] GAS CARTRIDGE SAFETY INFLATOR APPARATUS

[76] Inventor: Dennis Brown, 1358 Hooper Ave., Suite 240, Toms River, N.J. 08753

[21] Appl. No.: 683,775

[22] Filed: Jul. 17, 1996

[51] Int. Cl.[6] ..... B63C 9/125

[52] U.S. Cl. ..... 441/94; 116/277; 116/309; 137/68.18; 222/5; 222/48; 441/93

[58] Field of Search ..... 222/3, 5, 48, 80, 222/81, 83, 83.5; 137/68.18, 553, 556; 441/93–95; 116/277, 280, 284, 285, 303, 307, 309; 141/330, 329

[56] References Cited

U.S. PATENT DOCUMENTS 824,163 6/1906 Whitney ..... 137/553
3,266,668 8/1966 Davis ..... 441/94
4,972,971 11/1990 Janko et al. ..... 222/5
5,333,656 8/1994 Mackal ..... 222/5

*Primary Examiner*—Edwin L. Swinehart
*Attorney, Agent, or Firm*—Charles I. Brodsky

[57] ABSTRACT

A gas cartridge introduced into the housing of the invention is punctured by a pin moved by an arm designed to show through a window whether the cartridge is full or empty. A pulling on a tab rotates the arm to action, in puncturing the cartridge and a spring then locks the visual display in position. The pin is provided with a cone-shaped head which prevents any re-arming of the arm from changing the display to show that the cartridge is full, when in fact the cartridge has been spent.

15 Claims, 11 Drawing Sheets

GAS CARTRIDGE SAFETY INFLATOR APPARATUS

FIELD OF THE INVENTION

This invention relates to the marine inflatable device industry and, more particularly, to apparatus for inflating life vests, life rafts and the like.

BACKGROUND OF THE INVENTION

Small cartridges which hold large quantities of carbon dioxide or other gases under compression are well known in the art, for inflating life preservers, vests, rafts, or other similar such devices. Typical ones are shown in the Mackal patents, Nos. 3,809,288; 4,223,805; 4,267,944; 4,498,605; 5,058,635; and 5,333,656. As U.S. Pat. No. 5,333,656 pointed out, one problem in the industry followed from the fact that there existed no real way to quickly determine whether a cartridge attached to an inflator had been used or not. Since a discharged cartridge is virtually identical in outward appearance to a fully charged one, a danger always was present that once a user discharged and repacked the inflatable device, he or she might simply forget to replace the discharged cartridge first with a new one. As this patent noted, the only way to check the status of the cartridge was to unscrew it, and visually inspect its membrane to see whether it had been punctured.

The solution to that problem, in U.S. Pat. No. 5,333,656, was to paint a red sign on an inflator arm, to appear in a window when the arm was in the discharge position, indicating that the cartridge was spent. The theory behind it was that until a full cartridge was placed into position instead, the red sign would not disappear. Testing, however, showed that while that might be what was desired, the red sign often disappeared when one screwed the spent cartridge back in place, or when it was replaced with one that had already been discharged. Further testing revealed, in fact, that no matter what the condition of the replacement cartridge was, the red sign on the inflator arm was moved out of the viewing area—and not necessarily only when a full cartridge was reinserted. Investigation revealed that this followed from the irregular type hole the patent's chisel-shaped pin produced in puncturing the cartridge—so that upon replacement, the frequent misalignment between the pin and the hole which resulted pushed the pin backward, causing the red sign to disappear from the window. The purpose of the invention—to show that an empty cartridge was in place—oftentimes thus was defeated.

Further testing showed that even with the improved puncture pin described in Mackal's earlier U.S. Pat. No. 5,058,635, the problem persisted—and for the reason that the chisel-shaped head often caused the puncture hole rim to snag on the pin, and because it also included an internal spring biased in a direction to exert a backward pull on the puncture pin. This biasing was noted to sometimes snag and lodge on its way into the charged cartridge of conventional design during detonation—which interfered with the venting and inflation desired.

Thus, while some advances may have been made to determine if the cartridge is full or empty without first having to remove the cartridge from engagement, problems still remain to having these devices operate consistently, in providing the detection required.

OBJECTS OF THE INVENTION

It is an object of the present invention to overcome the limitations of safety inflator apparatus known in the prior art.

It is another object of the invention to provide a new and improved safety inflator apparatus which is inexpensive to manufacture, and reliable in its operation.

It is a further object of the invention to provide such a safety inflator apparatus which affords an easy manner of visually determining the condition of the cartridge in the inflator apparatus, and which allows the maximum venting of the cartridge to quickly fill life vests, life rafts, and the like, when inflated.

SUMMARY OF THE INVENTION

As will become clear from the description that follows, a gas cartridge introduced into the housing of the invention is punctured by a pin moved by an arm designed to show through a window whether the cartridge is full (colored "GREEN") or empty (colored "RED"). A pulling on a tab rotates the arm to action, in puncturing the cartridge, and a spring locks the visual display portion to show the color RED. As will be seen, the pin is provided with a cone-shaped head which prevents any re-arming of the arm from changing the display from RED to GREEN, showing when the cartridge is full, when, in fact, the cartridge has previously been spent.

As will become clear from the description, the arm is disclosed as having a cam surface at one end, a lanyard secured at a second end, and a tab coupled to the lanyard for rotating the arm once pulled. A second arm is provided, having a shaft proximate to the cam surface, a head at one end thereof divided into the GREEN and RED visual sections, and a pin at a second end about which the shaft is actuable to rotate. With the first and second arms being enclosed within a housing which also includes front and rear internal walls defining a chamber, a spring is then secured at a first location in the housing, and to the second arm. An inflator pin is also included, within the chamber of the housing, quiescently positioned to extend beyond the rear internal wall, and movable in direction towards and through the front internal wall, and towards and through the rear internal wall. In accordance with the preferred embodiment of the invention, the inflator pin is constructed to have a head end of a cone-shaped cross-section to bear against a gas cartridge introduced into the housing, a barrel end to bear against the shaft of the second arm, and a body including a vent channel. A window is further provided for viewing the GREEN and RED colorations on the head of the second arm, so as to display the color GREEN prior to the tab being pulled, and to display the color RED after the tab is pulled. In accordance with the teachings of the invention, the inflator pin forms a round hole when it punctures the gas cartridge, and which fits in perfect alignment through any rounded hole of a spent cartridge thereafter introduced, with clearance so as to prevent the pin from being moved rearwardly, changing the coloration through the window back to GREEN.

As will also be described, the spring of the invention is oriented to be compressed to a locked position after the tab is pulled, continuing to display the color RED for empty, after first being in an uncompressed, released position prior to the tab being pulled in detonating the cartridge. So as to make the display more easily visible in appraising the user as to the condition of the cartridge installed, a second window may be incorporated in the housing—with one being on a front surface of the housing, for example, and with the other being on the top surface of the housing. Utilizing a cam surface on the arm, furthermore, will be appreciated to make the apparatus faster acting in response to a pulling on the tab and lanyard—as does constructing the puncture pin to have either a vent channel as part of its construction, or as a hollow conical pin freeing a path for the compressed gas —be it carbon dioxide or otherwise—to flow into a manifold in inflating the life preserver, vest, raft or other inflatable device being filled.

BRIEF DESCRIPTION OF THE DRAWINGS

These and other features of the invention will be more clearly understood from a consideration of the following description of the drawings, in which.

DETAILED DESCRIPTION OF THE DRAWINGS

Figure 1:
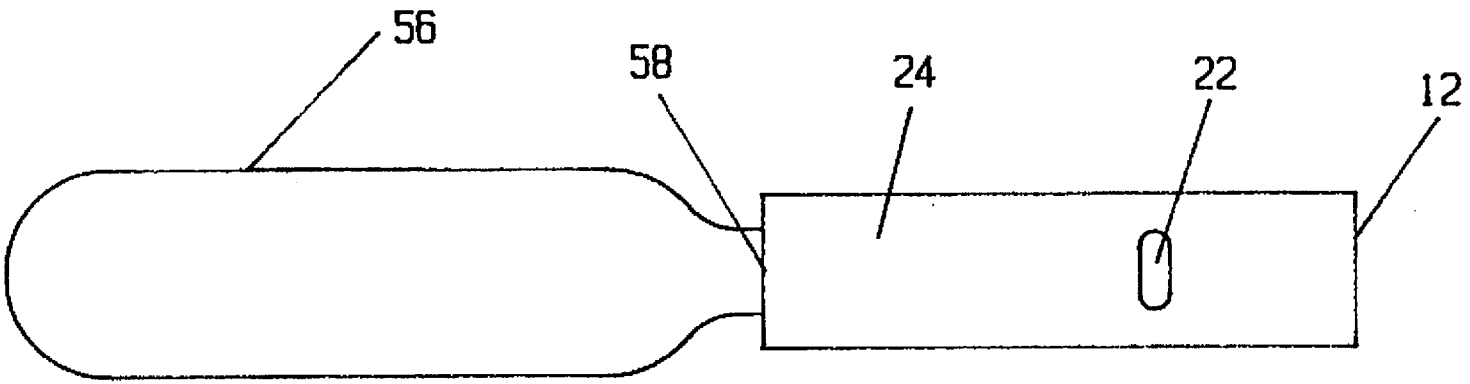
FIG. 1 is a top view of a gas cartridge safety inflator apparatus according to the invention.
Figure 2:
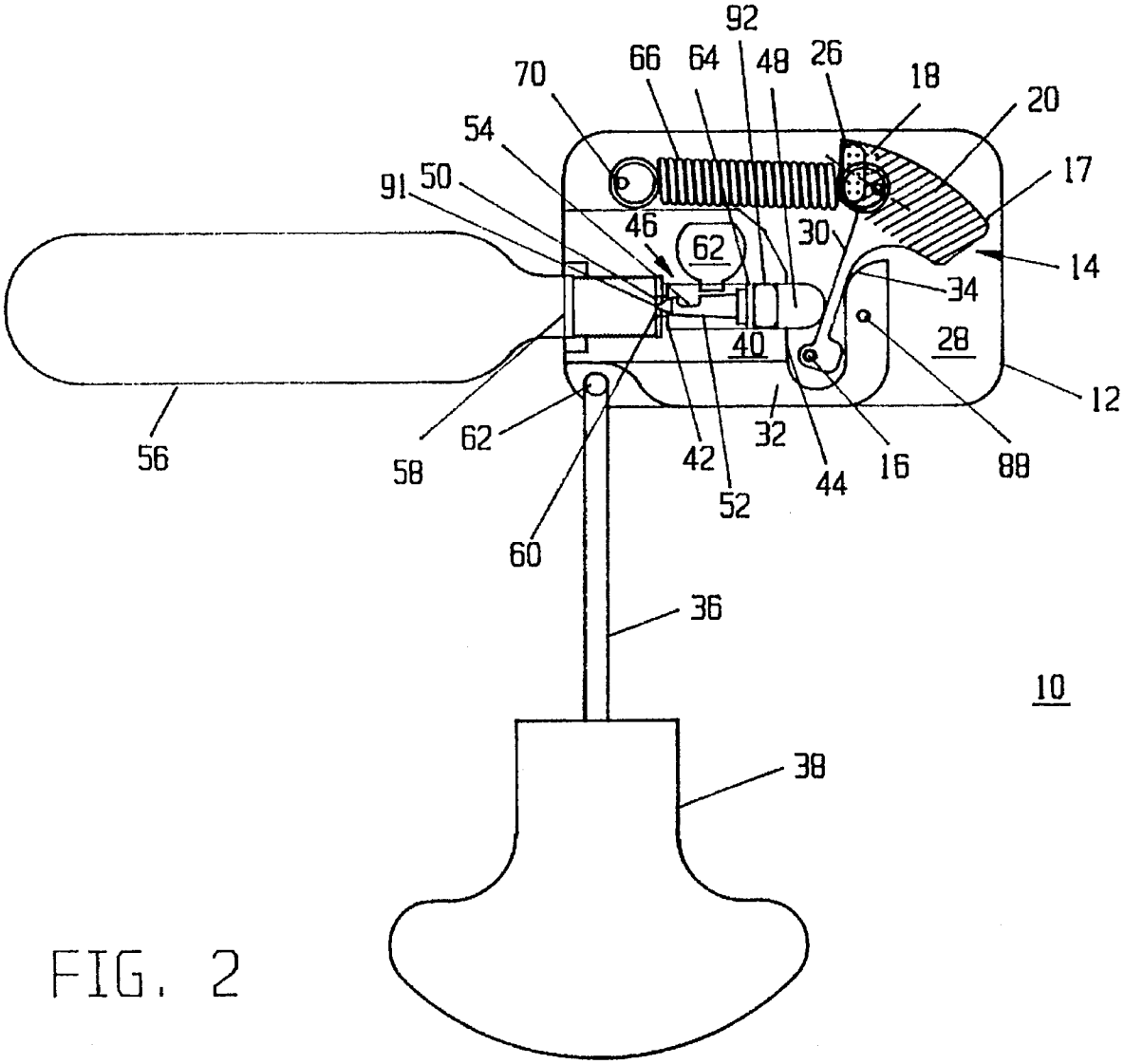
FIGS. 2–3 are front elevational views of the gas cartridge safety inflator apparatus of FIG. 1, helpful in an understanding of the invention.
Figure 3:
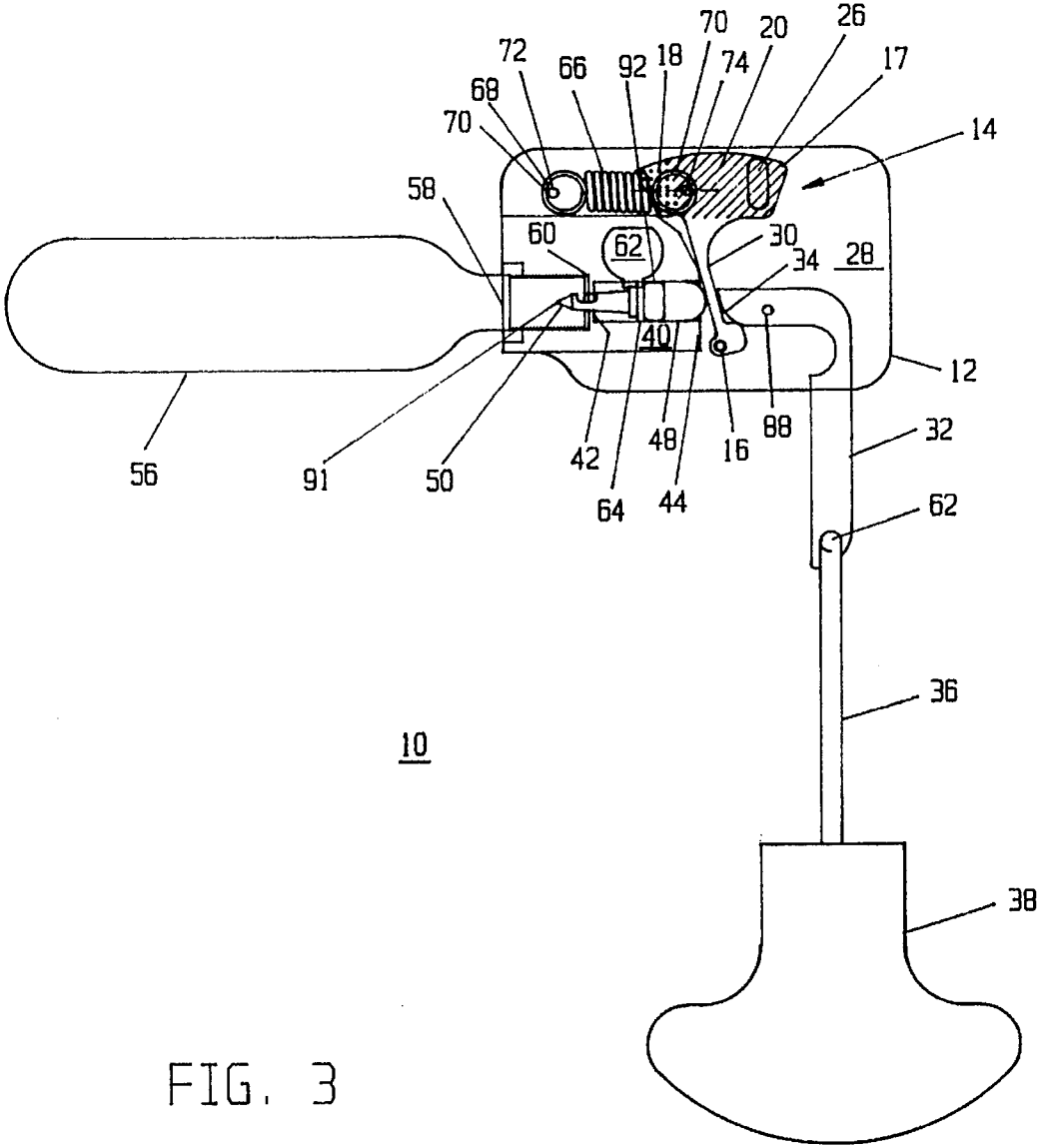

In FIGS. 1–3, the gas cartridge safety inflator apparatus 10 includes a housing 12, inside of which a lever or arm 14 is shown, secured by a pin 16 fixed to the housing 12. As indicated, the front half and top of the lever 14, i.e., at its head 17, is colored GREEN, as indicated by the dotted area 18, while the rear half and top of the lever 14 is colored RED as indicated by the hatched area 20.

A window 22 is located on a top surface 24 of the housing 12, and a second window 26 is located directly in alignment with the window 22 on a side surface 28 of the housing 12. As shown, the lever 14 also includes a shaft 30 extending between the head 17 of the lever 14, and where the lever 14 is pinned, as at 16.

Also shown in the housing 12 is an arm 32 having a cam surface 34 at one end proximate to the shaft 30, a lanyard 36 secured at a second end of the arm 32, and a tab 38 coupled to the lanyard 36 for rotating the arm 32 when the tab 38 is pulled. As will be seen, pulling down of the tab 38 rotates the arm 32 such that its cam surface 34 bears against the shaft 30, rotating it to the left, or counterclockwise in FIGS. 2 and 3. As will also be seen, prior to pulling on the tab 38, the position of the lever 14 and its head 17 is such that the GREEN coloration on the dotted area 18 is viewable both through the top window 22 and the side window 26 (FIG. 2).

Additionally shown in FIGS. 2 and 3 is a chamber 40 within the housing 12, in part defined by internal front and rear housing walls 42, 44 respectively. Within the chamber 40 is a puncture pin 46, having a barrel end 48 which extends through the rear housing wall 44, and a head end 50 of cone-shaped cross-section which extends through the front housing wall 42. The puncture pin 46 also incorporates a body 52 having a vent hole shown as 54. A fully-charged gas cartridge 56 is securely screwed into the housing at 58 in alignment, so that the head end 50 of the pin 46 is in alignment with the center of the cartridge cap 60. As will be seen, screwing in the cartridge 56 forces the cap 60 to bear against the head end 50 of the puncture pin 46, forcing the barrel end 48 against the shaft 30 so as to rotate the head 17 clockwise, to the right, in displaying the GREEN coloration 18 through the viewing windows 22, 26.

In this armed position, the apparatus of the invention then is activated by jerking downward sharply on the pull-tab 38 which is secured to the inflator arm 32 by the lanyard 36 pinned to the arm 32 at 62. Such jerking-down on the pull-tab 38 rotates the arm 32 and forces the cam surface 34 against the shaft 30, forcing the shaft 30 against the barrel end 48 of the puncture pin 46. Such force as is produced upon the barrel end 48 which extends beyond the rear housing wall 44 forces the head end of the puncture pin sharply forward to penetrate the cap 60 of the cartridge 56 in detonating it (FIG. 3). The detonation releases the compressed carbon dioxide, or other, gas, which then passes behind the head end 50 by means of the vent channel 54. The compressed gas then flows through a manifold hole 62 to fill the inflatable life preserver, vest, raft, etc., with an O-ring 92 being included to prevent the compressed gas from escaping the chamber 40, other than through the manifold hole 62. Reference numeral 64, in this respect, represents the front retaining wall for the O-ring 92.

To increase the speed with which this takes place, the barrel end 48 of the puncture pin 46 is positioned to bear against the shaft 30 at a point nearer to the pin 16 than to the head 17 (FIG. 2). Also to hasten the speed, the cam surface 34 is positioned with respect to the shaft 30 nearer to the head 17 of the arm 14 than to the pin 16. As also shown to insure that all this takes place quickly, the barrel end 48 of the puncture pin 46 extends beyond the rear housing wall a distance beyond the location. of the pin 16. Thus, once the tab 38 is jerked downwardly, the cam surface 34 positively acts on the shaft 30 to propel the pin 46 forwardly of the front housing wall 42, to puncture the metal cap 60, in detonating the cartridge 56. As FIG. 3 further shows, the counterclockwise movement, to the left, of the head 17 also moves the RED coloration 20 into the viewing areas 22, 26, to then indicate the cartridge to be discharged, spent, or fully empty.

In other words, since the arm 14 has been moved to the left by the cam surface 34, the GREEN colored half 18 disappears from the two windows 22, 26, and the RED colored half 20 then appears in both windows. A user looking through the windows 22, 26, or either of them, is quickly able to determine the condition of the cartridge 56, being then either full or empty, as the case may be.

Also shown in FIGS. 2 and 3 is a spring 66, secured at one end 68 to the housing 12, and at the other end 70 to the head 17 of the lever arm 14. Such spring 66 is of a design to remain locked in the forward position of FIG. 3 by means of the pins 72, 74. The arm 14, in the forward position of FIG. 3, thereby exerts a constant and steady pressure on the pin 46, which is locked into the spent position, protruding through the front internal housing wall 42. The RED coloration of the area 20 of the head 17 thus continues to be displayed through the windows 22, 26.

As was previously mentioned, the head end 50 of the puncture pin 46 is of cone-shaped cross-section in bearing against the metal cap 60 of the cartridge 56. Such cone shaping creates a perfectly round hole in the metal cap 60, in offering a very distinct advantage in the event one were to later attempt to replace the cartridge 56 with another cartridge, believed to be full, when in fact it had previously been detonated. Screwing in the replacement cartridge would then accept the cone-shaped head 50 in the previously made perfectly round hole in the cap 60, which would prevent any force being applied against the head end 50 in a direction to overcome the bias of the spring 66 in returning the arm 14 to its initial, quiescent position, by rotating it clockwise, to the right. Replacing the spent cartridge 56 with one that was previously fired, thus, does not change the RED coloration showing through the windows 22, 26. Where the replacement cartridge is full, however, with the metal cap 60 in place, that metal cap forces the head end 50 and the pin 46 through the rear housing wall 44, against the shaft 30, releasing the lock on the spring 66, rotating the arm 14, and bringing the GREEN coloration 18 back into the window areas.

Figure 4A:
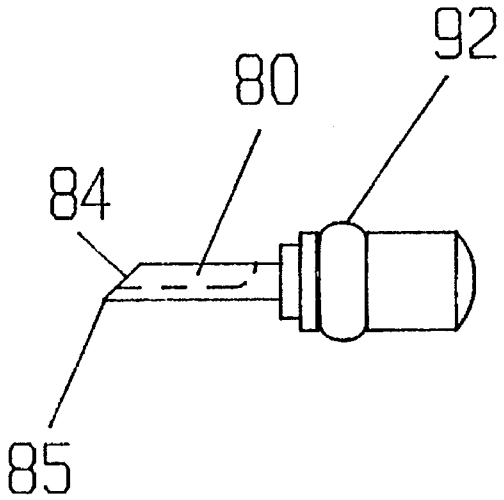
FIG. 4a PRIOR ART
FIGS. 4*a* and 4*b* illustrate puncture pins known in the prior art in detonating a gas cartridge for marine inflatable devices.
Figure 4B:
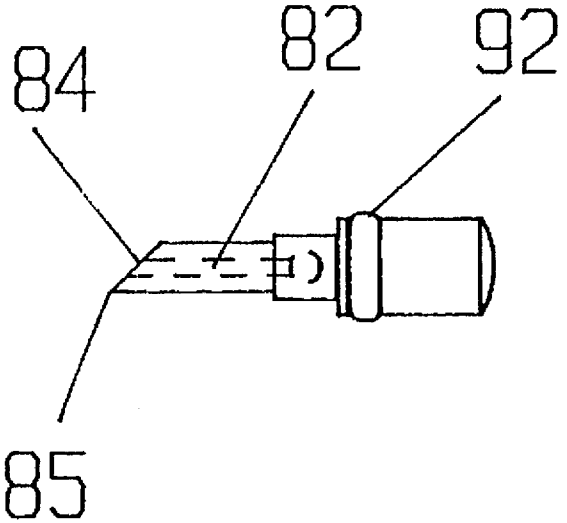
FIG. 4b PRIOR ART

FIGS. 4*a* and 4*b* illustrate two puncture pins known in the prior art which do not allow for this feature. Both the pins of FIGS. 4*a* and 4*b*—having a vent channel 80 and a hollow body 82, respectively—incorporate chisel-shaped heads 84 which testing has shown do not always align with the holes made by them in the metal caps they puncture. In those instances, screwing in of a spent cartridge frequently brings the metal cap of the cartridge against the tip 85—which has the very undesirable feature of moving the lever arm 14 clockwise, to the right, and erroneously displaying the GREEN coloration area 18, to falsely indicate the cartridge as being filled.

Figure 4C:
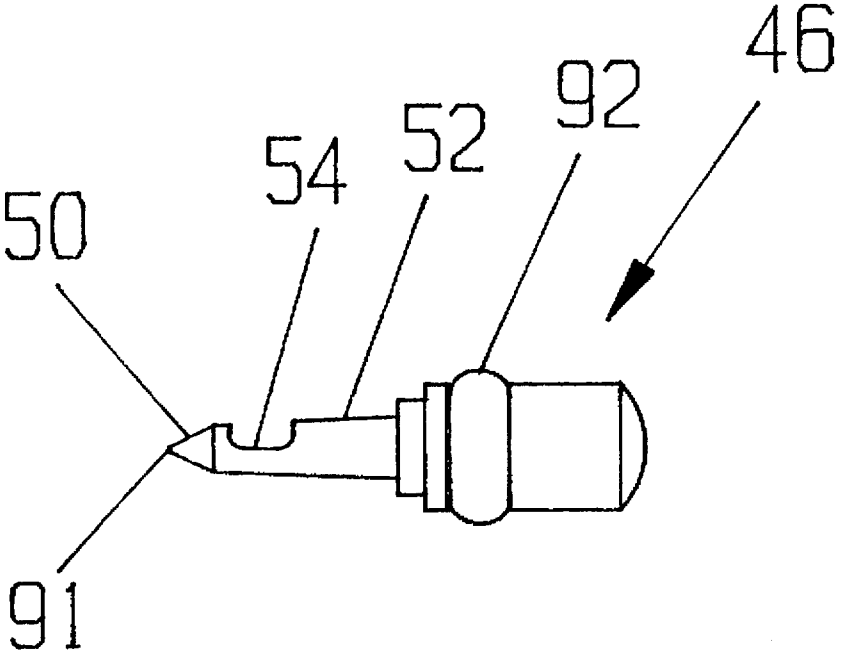
FIG. 4*c* shows a puncture pin constructed in accordance with the invention to detonate a gas cartridge of the type illustrated in FIG. 1.
Figure 5A:
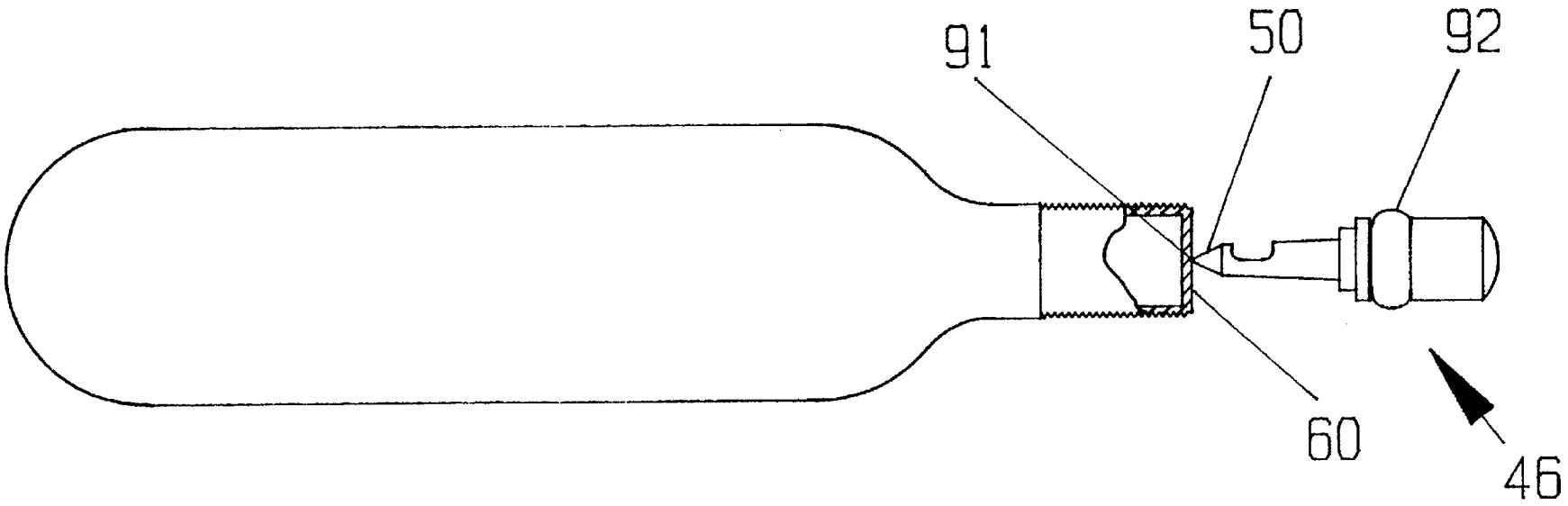
FIGS. 5*a*–5*d* schematically illustrate the operation of the puncture pin of the invention in operating the improved safety inflator apparatus incorporating the teachings herein.
Figure 5B:
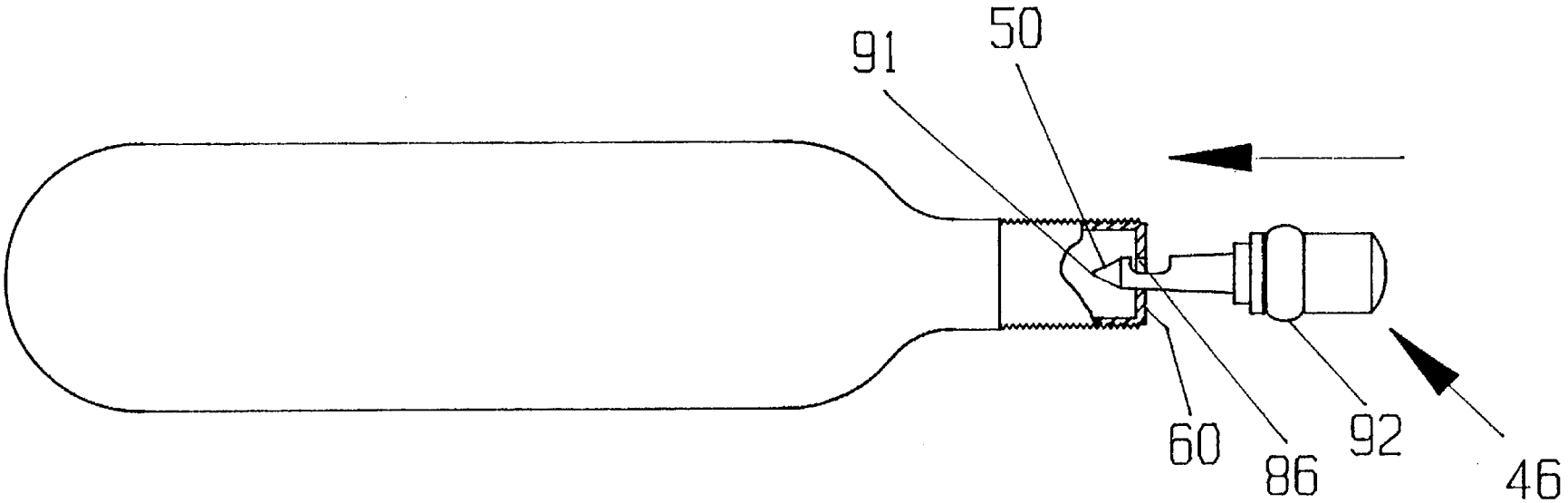
Figure 5C:
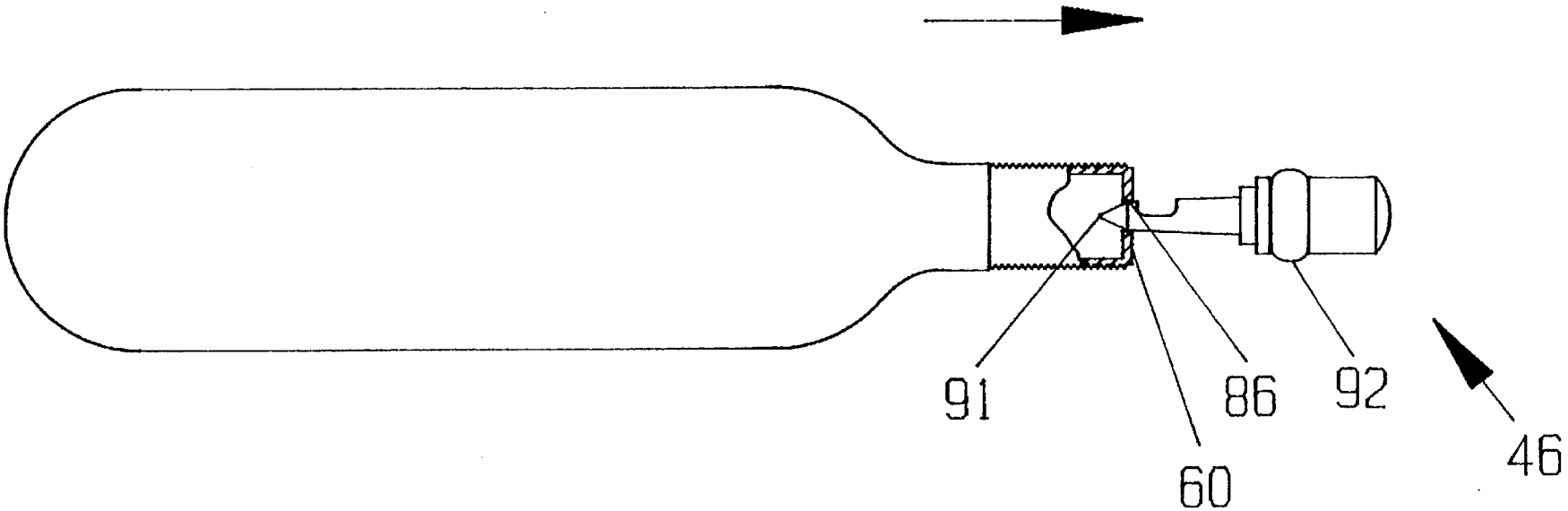
Figure 5D:
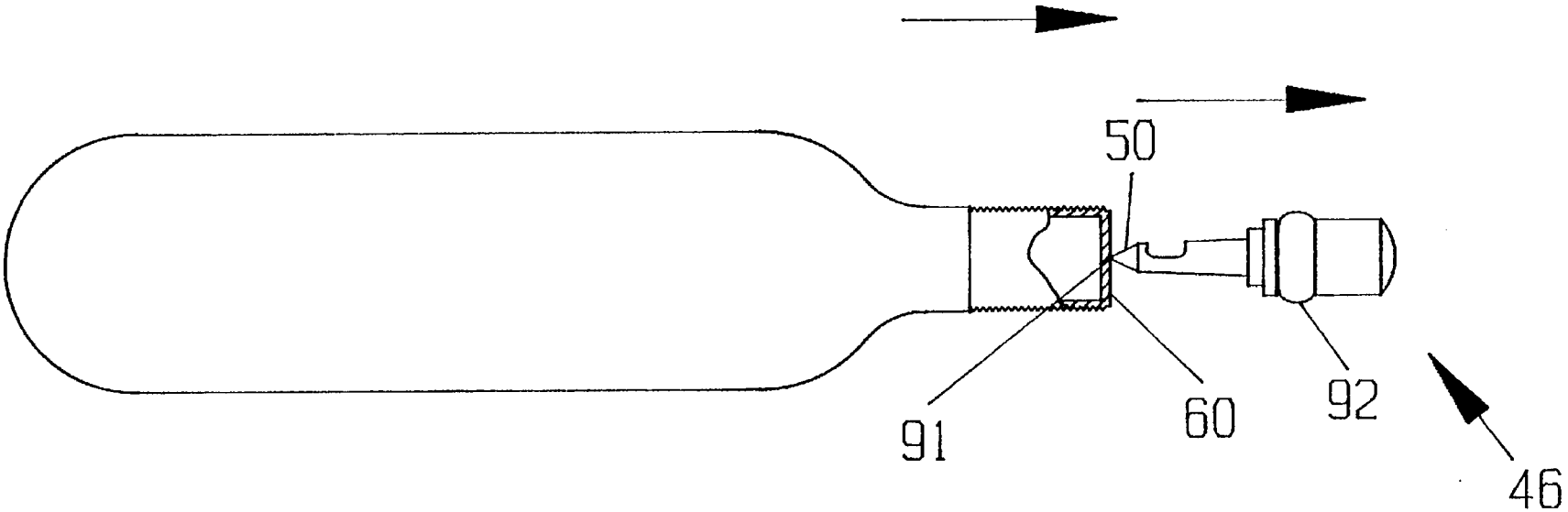

FIG. 4*c* illustrates the puncture pin 46 embodying the invention. As shown, its head 50 has a cone-shaped cross-section to create a perfectly circular hole in the metal cap of the gas cartridge 56. The head 50 of the pin 46 incorporates a barely perceptible flat head 91, which bears against the metal cap of the cartridge 56 without prematurely puncturing it as might be the case if the head 50 were pointed instead. As illustrated, directly behind the head 50 is a vent hole 54, which is a part of the puncture pin body 52, understood to be circular, and tapered along its length. As will be appreciated, the circular tapering of the body 52 serves the purpose of acting as an extension of the cone-shaped head, to thereby insure that should the metal cap of the gas cartridge pass beyond the head 50 and vent hole 54, the round puncture hole will continue to be of a perfectly round configuration.

FIGS. 5*a*–5*d* illustrate the different stages of operating the safety inflator apparatus of the invention. In stage one of FIGS. 5*a*, the puncture pin 46 is shown with its cone-shaped head 50 bearing against the metal cap 60 prior to pulling on the tab 38. In the stage two showing of FIG. 5*b*, the tab 38 has been pulled, the cam surface 34 and the shaft 30 have been rotated, to force the puncture pin 46 into the metal cap 60, providing a perfectly round hole, 86. In stage three of FIG. 5*c*, a spent cartridge is being screwed into the housing 12, but the round hole 86 in the cap 60 continues to accept the cone-shaped head 50, so that no force is exerted on the pin 46 to force it to the right, to rotate the shaft 30 and the arm 14 to change the displayed color from RED back to GREEN. In stage four of FIG. 5*d*, a full cartridge 56 is being screwed into the housing 12, and its metal cap 60, devoid of any previously rounded hole 86, bears against the barely perceptible flat tip 91 of the head end 50 of the pin 46, to move it rearwardly, against the shaft 30, so as to rotate the arm 14 and change the window display to GREEN. Testing has shown that with the conical head of the puncture pin 46, such pin can enter the discharged gas cartridge without forcing the pin backward to change the RED window to GREEN, while at the same time prevents any snagging or limitation of the fast venting of the cartridge once punctured.

As will also be appreciated, such insertion of a fully charged replacement cartridge (FIG. 5*d*) also rotates the shaft 30 against the cam surface 34, thereby rotating the arm 32 about the pin 88 securing it to the housing, to raise the arm 32, the lanyard 36 and the tab 38 back to the original position of FIG. 2, from that shown in FIG. 3. Such insertion of the full replacement cartridge thereby re-arms the inflator apparatus of the invention, ready for use once again. As will be readily appreciated by those skilled in the art, this returning of the arm 32, the lanyard 36 and the tab 38 in itself serves to display that the apparatus is ready for detonation with a fully charged cartridge in place, as contrasted with its continued positioning in FIG. 3 where the replacement cartridge had itself previously been punctured.

Figure 6:
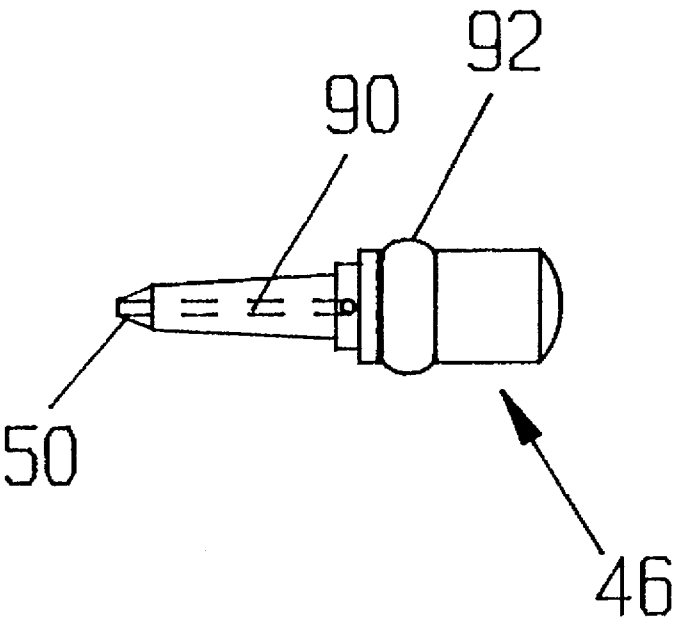
FIG. 6 shows an alternative puncture pin for puncturing the gas cartridge, useful in carrying out the operation of the preferred embodiment.

FIG. 6 shows an alternative type of puncture pin body 52, where instead of there being a vent hole 54 to couple the compressed gas to the manifold hole 62, the body is made hollow, as at 90 in speeding the flow of gas to the device being inflated.

Investigation with the constructions of the previously noted U.S. Pat. Nos. 5,058,635 and 5,333,656 further revealed that while there appeared to be a perfectly round puncture hole created in the cartridge by the chisel-shaped pin of those devices, either the hole was not exactly round, or not large enough to prevent the punctured cartridge, when it was inserted into the device, from forcing the pin backward and incorrectly displaying a green window, which of course defeated the purpose of the device. The flaw in the device was found to be caused by the chisel-shaped pin's snagging on the rim of the puncture hole, which forced the pin backward. This snagging effect could only be caused by a hole that is irregular in shape or not large enough to sufficiently clear the pin as the spent cartridge is screwed back into the inflator. Such clearance is of course necessary for the red sign to remain in the window and the device to work properly.

The almost imperceptible irregularity of the cone-shaped hole was noted to have several causes. One is that when a spent cartridge is reinserted into an inflator, it will often not line up in exactly the same position it was in when pierced by the pin, and this misalignment, however small, causes a portion of the hole rim to snag on the pin, which is then forced backward to incorrectly display a green window. Another cause is that often the inflator arm is not pulled back to its maximum distance when the device is inflated—and even though the slightest penetration of the cartridge membrane will cause venting of the carbon dioxide and proper inflation of the inflatable device, this action will also produce a much smaller hole in the cartridge than would be produced by pulling the inflator arm to its maximum distance, so that when the same spent cartridge is reinserted into the inflator, its hole is too small to sufficient clear the chisel-shaped pin, which in turn creates the problem already described. An additional, more obvious, cause is that if the chisel-shaped pin penetrates the cap even less minimally than is necessary to form an apparent circle, much less than a circular hole (e.g., a semicircular or arc-shaped hole) will be produced, again creating the problem already discussed.

Since the pin of this invention is cone-shaped, a perfectly round hole is created even when the cartridge cap is minimally pierced, and since the highest point of the cone is always located. in the dead center of the hole—unlike the highest point of the chisel-shaped pin which is located on the side of the pin, thereby inviting snagging much more easily—there will always be sufficient clearance from the sides of the spent cartridge hole to allow that cartridge to move past the pin without moving it backward.

While there have been described what are considered to be preferred embodiments of the present invention, it will be readily appreciated by those skilled in the art that modifications can be made without departing from the scope of the teachings herein. As an example, while the present invention has been described as utilizing pairs of windows 22, 26 to display the coloration on the head 17 of the lever 14, it is equally within the invention to incorporate, in general, one or more of these windows for permitting identification by color to be made. Such modification will be understood to be within the invention—as it would further be in accordance with the improvement set forth herein to employ other types of vent arrangements for the puncture pin 46, beyond that shown as having the vent in the nature of a channel extending along the entire length of the body of the pin, as being in the nature of a hole at the bottom or side of a hollow, cone-shaped pin, so as to eliminate the need for a vent on the exterior body of the pin. For at least such reason, therefore, resort should be had to the claims appended hereto for a true understanding of the scope of the invention.

I claim:

1. Apparatus adapted to receive and puncture a gas cartridge for the filling of an inflatable device, comprising:

a first arm having a cam surface at one end thereof, a lanyard secured at a second end thereof, and a tab coupled to said lanyard for rotating said arm when pulled;

a second arm having a shaft proximate to said cam surface, a head at one end thereof divided into first and second visually distinct sections, and a pin at a second end thereof about which said shaft is actuable to rotate;

a housing enclosing said first and second arms, and including a chamber defined by front and rear internal walls;

a spring secured at a first end within said housing, and at a second end to said second arm;

a window in said housing for viewing said first and second visually distinct sections of said head of said second arm;

an inflation pin within said chamber, quiescently positioned to extend beyond said rear internal wall, and movable in direction towards and through said front internal wall, and towards and through said rear internal wall;

with said pin having a head end of cone-shaped cross-section to bear against a gas cartridge introduced into said housing, a barrel end to bear against said shaft of said second arm, and a body including a vent means;

wherein said first visually distinct section is viewable through said window prior to said tab being pulled, and wherein said second visually distinct section is viewable through said window after said tab is pulled;

and wherein said pin forms a round hole in a cap of said cartridge when brought against said cartridge to bear against said cap upon pulling of said tab.

2. The apparatus of claim 1 wherein said spring is compressed to a locked position after said tab is pulled, and in a uncompressed, released position prior to said tab being pulled.

3. The apparatus of claim 1 wherein a front surface of said head is divided into said first and second visually distinct sections, and wherein said window is situated on a side surface of said housing.

4. The apparatus of claim 1 wherein a top surface of said head is divided into said first and second visually distinct sections, and wherein said window is situated on a top surface of said housing.

5. The apparatus of claim 3 wherein a top surface of said head is additionally divided into first and second visually distinct sections, and wherein there is additionally included a second window on a top surface of said housing for viewing said first and second visually distinct sections of said head on said second arm.

6. The apparatus of claim 1 wherein said first visually distinct section is colored "GREEN" and wherein said second visually distinct section is colored "RED".

7. The apparatus of claim 1 wherein there is additionally including in said housing, a manifold exhaust for coupling said housing to an inflatable device to be filled with gas from said cartridge.

8. The apparatus of claim 1 wherein said barrel end of said pin is positioned to bear against said shaft of said second arm at a point nearer to said pin on said second arm than to said head on said second arm.

9. The apparatus of claim 8 wherein said cam surface of said first arm is positioned proximate to said shaft of said second arm at a position nearer to said head of said second arm than to said pin on said second arm.

10. The apparatus of claim 1 wherein said barrel end of said pin quiescently extends beyond said rear internal wall of said housing, and beyond the location of said pin on said second arm.

11. The apparatus of claim 1 wherein said vent means comprises a channel extending along the entire exterior length of said body of said pin.

12. The apparatus of claim 1 wherein said inflation pin is of hollow configuration and wherein said vent means comprises a hole along said body of said pin.

13. Apparatus adapted to receive and puncture a gas cartridge for the filling of an inflatable device, comprising:

a first arm having a cam surface at one end thereof, a lanyard secured at a second end thereof, and a tab coupled to said lanyard for rotating said arm when pulled;

a second arm having a shaft proximate to said cam surface, a head at one end thereof divided into first and second visually distinct sections, and a pin at a second end thereof about which said shaft is actuable to rotate;

a housing enclosing said first and second arms, and including a chamber defined by front and rear internal walls;

a spring secured at a first end within said housing, and at a second end to said second arm;

at least one window in said housing for viewing said first and second visually distinct sections of said head of said second arm;

an inflation pin within said chamber, quiescently positioned to extend beyond said rear internal wall, and movable in direction towards and through said front internal wall, and towards and through said rear internal wall;

with said pin having a head end of cone-shaped cross-section to bear against a gas cartridge introduced into said housing, a barrel end to bear against said shaft of said second arm, and a body including a vent means;

wherein said first visually distinct section is viewable through said window prior to said tab being pulled, and wherein said second visually distinct section is viewable through said window after said tab is pulled;

and wherein said pin forms a round hole in a cap of said cartridge when brought against said cartridge to bear against said cap upon pulling of said tab.

14. The apparatus of claim 13 wherein said body of said pin is of a circular cross-section, tapered along its length and wherein said vent means includes a vent hole.

15. The apparatus of claim 14 wherein said cone-shaped head of said pin includes a flat tip bearing against said introduced gas cartridge.

* * * * *